US005329641A

United States Patent [19]

Kalhous

[11] Patent Number: 5,329,641

[45] Date of Patent: Jul. 19, 1994

[54] HELMET WITH NECK-SHIELD

[76] Inventor: Tom Kalhous, RRMC, FMO Victoria, British Columbia, Canada, V0S 1B0

[21] Appl. No.: 65,476

[22] Filed: May 24, 1993

[51] Int. Cl.[5] ..... A42B 1/24

[52] U.S. Cl. ..... 2/422; 2/424

[58] Field of Search ..... 2/2, 410, 413, 415, 2/422, 424, 425, 9, 129, 135, 171.2, 171.4, 184.5, 205

[56] References Cited

U.S. PATENT DOCUMENTS

| | | | |
|---|---|---|---|
| 3,825,952 | 7/1974 | Pershing et al. | 2/422 |
| 4,017,906 | 4/1977 | Bochynsky et al. | 2/205 |
| 4,042,976 | 8/1977 | Reynolds | 2/135 |
| 4,274,161 | 6/1981 | Littler | 2/413 |
| 4,333,179 | 6/1982 | Laurita | 2/9 |
| 4,404,460 | 9/1983 | Kerr | 2/69 |
| 4,697,289 | 10/1987 | Luigi | 2/422 |
| 5,095,550 | 3/1992 | Perlinger | 2/422 |

FOREIGN PATENT DOCUMENTS

| | | | |
|---|---|---|---|
| 568033 | 10/1975 | Switzerland | 2/413 |
| 2048056 | 12/1980 | United Kingdom | 2/410 |

*Primary Examiner*—Clifford D. Crowder
*Assistant Examiner*—Michael A. Neas
*Attorney, Agent, or Firm*—S. Michael Bender

[57] ABSTRACT

A new and improved helmet with neck-shield is provided for a helmet which has a chin and jaw protecting area. The apparatus includes a neck-shielding assembly for protecting a neck area of a user without covering the eyes of the user. The neck-shielding assembly includes a curved upper portion capable of curving around the chin and jaw protecting area of the helmet. A curved lower portion extends downward from the curved upper portion and is capable of curving around a portion of the neck area of the user. A first connector is attached to the curved upper portion. The first connector connects the neck-shielding assembly to the chin and jaw protecting area of the helmet. The curved upper portion supports the curved lower portion, and the curved lower portion protects a portion of the neck area of the user from wind and airborne debris. A second connector is attached to the chin and jaw protecting area of the helmet. The second connector connects to the first connector and retains the neck-shielding assembly on the helmet. In this way, the neck-shielding assembly protects a portion of the neck of the user from wind and airborne debris without covering the eyes of the user. The first connector and the second connector may include complementary hook and loop connectors.

9 Claims, 4 Drawing Sheets

HELMET WITH NECK-SHIELD

BACKGROUND OF THE INVENTION

1. Field of the Invention

The present invention relates generally to helmets used by motorcycle and bicycle riders, and more particularly, to a helmet which includes apparatus especially adapted for protecting the neck of the rider.

2. Description of the Prior Art

Helmets worn by motorcycle and bicycle riders are primarily designed to afford head protection when the head is subjected to concussive force such as may occur in a collision or fall. However, during normal use, a serious problem that often confronts a user is the presence of wind at high speed. More specifically, the wind is often able to penetrate a motorcyclist's jacket by moving under the helmet, past the neck, under the jacket and into the rider's chest area. The wind that penetrates into the rider's chest area in this manner can be very uncomfortable and even a serious threat to the rider's health during cold and wet conditions. In this respect, it would be desirable if a helmet device were provided that prevented wind from entering a rider's chest area under a jacket by way of the rider's neck.

Once wind reaches the neck area of the rider, it can also advance upward from the neck to under the helmet. In this case, the wind entering by way of the neck can be very uncomfortable and even dangerous to the head area of the rider. In this respect, it would be desirable if helmet device were provided that prevented wind from entering a rider's head area under a helmet by way of the rider's neck.

When the neck area of the rider is not protected very well by the rider's helmet, the neck area itself is susceptible to injury from the wind. In this respect, it would be desirable if a helmet device were provided that protected a rider's neck from wind injury.

During motorcycle and bicycle riding, an inadequately protected neck area may be subjected to more than unpleasant wind conditions. During riding, a rider is often subjected to flying rocks and stones and contact with flying insects at high speed. Such solid objects, when contacting a rider's neck, can cause discomfort, pain, and even serious injury. In this respect, it would be desirable if a helmet device were provided that protected a rider's neck from contact with flying rocks and stones and contact with flying insects at high speed.

For a rider to be willing to wear any protective device, it is desirable that wearing the protective device provides more comfort than not wearing the protective device. This simple principle, when violated, often results in a rider doing without wearing an uncomfortable protective device. In this respect, it would be desirable if a helmet device were provided that protects the neck of the rider and is comfortable to wear.

Moreover, for a helmet-associated protective device to be used with consistency and regularity, it is important that the protective device not be difficult to be used and manipulated on the helmet. In this respect, it would be desirable if a helmet device for protecting a rider's neck were provided that is easily used and manipulated.

Aside from a desire to protect a rider's neck area from wind and debris, it must not be forgotten that the neck must have free, unconstricted movement while the rider is on the motorcycle. More specifically, the rider must be able to readily turn one's head to keep aware of traffic conditions all around the rider. A neck-protective device that constricted neck motion may itself be hazardous. Therefore, in this respect, it would be desirable if a helmet device were provided that protected the neck of the rider without constricting neck and head movement of the rider.

The concept of an air bag providing an air cushion is well accepted as a safety device for protecting rider's in motor vehicles. In this respect, it would be desirable if a helmet device were provided that employed an air cushion for protecting a rider's neck area.

Air tight seals are often employed to prevent air flow from one location to another. Some forms of air tight seals depend upon an inflatable member to provide the air tight seal. In this respect, it would be desirable if a helmet device were provided that employed the principles of an inflatable seal to protect a rider's neck area from the wind.

To overcome cold conditions, good insulation is not always enough. Sometimes it is desirable to provide an active source of heat to warm a cold area. In this respect, it would be desirable if a helmet device were provided that included an active source of heat for warming the rider's neck area.

A number of modifications of headgear are known in the prior art, and the following U.S. patents represent some of these modifications: U.S. Pat. Nos. 3,551,910; 3,594,816; 3,797,042; 4,993,081; and Des. 287,300. More specifically, U.S. Pat. Nos. 3,551,910, 3,594,816, 3,797,042, and Des. 287,300 disclose face shields for safety helmets. The face shield primarily protect the face areas and afford little protection for the neck. Moreover, they provide virtually no features for preventing wind from entering a rider's chest area under a jacket or entering a rider's head area under a helmet by way of the rider's neck. U.S. Pat. No. 4,993,081 may be of interest for its disclosure of a flexible sun shield used on a hard hat or military helmet.

The face shields disclosed in the patents cited above have panels which cover the eye area. As such, they impose an additional visual obstacle between the eyes of the wearer and the surroundings. Such an additional visual obstacle may impeded proper vision and impose additional dangers. In this respect, it would be desirable if a helmet device were provided that provided neck protection without adding a visual obstacle to the wearer.

The face shields in the prior art disclosed above have complex means for connecting the face shield to the helmet. In this respect, it would be desirable if a helmet device were provided that had neck-protecting features that is readily attached to and detached from the helmet.

Generally, the face shields in the prior art are attached to the helmet at the top of the helmet. For a face shield that covers the face area, this may be practical. However, for a neck-protecting apparatus that does not cover the eye area, it would be desirable if the neck-protecting apparatus would not be attached at the top of the helmet.

Thus, while the foregoing body of prior art indicates it to be well known to use helmets for motorcycle and bicycle riders, the prior art described above does not teach or suggest a helmet with neck-shield which has the following combination of desirable features: (1) prevents wind from entering a rider's chest area under a jacket by way of the rider's neck; (2) prevents wind from entering a rider's head area under a helmet by way of the rider's neck; (3) protects a rider's neck from wind injury; (4) protects a rider's neck from flying rocks and stones and contact with flying insects at high speed; (5) protects the neck of the rider and is comfortable to wear; (6) protects a rider's neck and is easily used and manipulated; (7) protects the neck of the rider without constricting the rider's neck and head movement; (8) employs an air cushion for protecting a rider's neck area; (9) employs the principles of an inflatable seal to protect a rider's neck area from the wind; (10) includes an active source of heat for warming the rider's neck area; (11) provides neck protection without adding a visual obstacle to the wearer; (12) is readily attached to and detached from the helmet; and (13) is not attached at the top of the helmet. The foregoing desired characteristics are provided by the unique helmet with neck-shield of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved helmet with neck-shield for a helmet which has a chin and jaw protecting area. The apparatus includes a neck-shielding assembly for protecting a neck area of a user without covering the eyes of the user. The neck-shielding assembly includes a curved upper portion capable of curving around the chin and jaw protecting area of the helmet. A curved lower portion extends downward from the curved upper portion and is capable of curving around a portion of the neck area of the user. A first connector is attached to the curved upper portion. The first connector connects the neck-shielding assembly to the chin and jaw protecting area of the helmet. The curved upper portion supports the curved lower portion, and the curved lower portion protects a portion of the neck area of the user from wind and airborne debris. A second connector is attached to the chin and jaw protecting area of the helmet. The second connector connects to the first connector and retains the neck-shielding assembly on the helmet. In this way, the neck-shielding assembly protects a portion of the neck of the user from wind and airborne debris without covering the eyes of the user. The first connector and the second connector may include complementary hook and loop connectors.

A first inflatable air bladder assembly may be connected to the curved lower portion for restricting air flow between the curved lower portion of the neck-shielding assembly and the neck of the user. A second inflatable air bladder assembly may be connected to a first edge portion of the curved upper portion and to a second edge portion of the curved lower portion of the neck-shielding assembly. The first and second inflatable air bladder assemblies restrict air flow between the curved upper portion and the curved lower portion of the neck-shielding assembly and the neck of the user.

A third connector may be connected to the second inflatable air bladder assembly for attaching the neck-shielding assembly to the helmet. A fourth connector may be connected to the helmet in the chin and jaw protecting area. The fourth connector connects with the third connector for attaching the neck-shielding assembly to the helmet. The third connector and the fourth connector may include complementary hook and loop connectors.

A heater assembly may be provided for warming the neck of the user. The heater assembly may include a heater element and a battery power source connected to the heater element. The heater element may be attached to the first inflatable air bladder assembly for warming the neck of the user. The battery power source may include a rechargeable battery.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved helmet with neck-shield which has all of the advantages of the prior art and none of the disadvantages.

It is another object of the present invention to provide a new and improved helmet with neck-shielding apparatus which may be easily and efficiently manufactured and marketed.

It is a further object of the present invention to provide a new and improved helmet with neck-shield which is of durable and reliable construction.

An even further object of the present invention is to provide a new and improved helmet with neck-shield which is susceptible of a low cost of manufacture with regard to both materials and labor, and which accordingly is then susceptible of low prices of sale to the consuming public, thereby making such helmet with neck-shielding apparatus available to the buying public.

Still yet a further object of the present invention is to provide a new and improved helmet with neck-shield which prevents wind from entering a rider's chest area under a jacket by way of the rider's neck.

Still another object of the present invention is to provide a new and improved helmet with neck-shielding apparatus that prevents wind from entering a rider's head area under a helmet by way of the rider's neck.

Yet another object of the present invention is to provide a new and improved helmet with neck-shielding apparatus which protects a rider's neck from wind injury.

Even another object of the present invention is to provide a new and improved helmet with neck-shield that protects a rider's neck from flying rocks and stones and contact with flying insects at high speed.

Still a further object of the present invention is to provide a new and improved helmet with neck-shield which protects the neck of the rider and is comfortable to wear.

Yet another object of the present invention is to provide a new and improved helmet with neck-shielding apparatus that protects a rider's neck and is easily used and manipulated.

Still another object of the present invention is to provide a new and improved helmet with neck-shield which protects the neck of the rider without constricting the rider's neck and head movement.

Yet another object of the present invention is to provide a new and improved helmet with neck-shielding apparatus employs an air cushion for protecting a rider's neck area.

Still a further object of the present invention is to privide a new and improved helmet with neck-shielding apparatus that employs the principles of an inflatable seal to protect a rider's neck area from the wind.

Yet another object of the present invention is to provide a new and improved helmet with neck-shielding apparatus which includes an active source of heat for warming the rider's neck area.

Still yet a further object of the present invention is to provide a new and improved helment with neck-shield which provides neck protection without adding a visual obstacle to the wearer.

Still another object of the present invention is to provide a new and improved helmet with neck-shielding apparatus that is readily attached to and detached from the helmet.

Yet another object of the present invention is to provide a new and improved helmet with neck-shielding apparatus which is not attached at the top of the helmet.

The together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved helmet with neck-shield embodying the principles and concepts of the present invention will be described.

Figure 2:
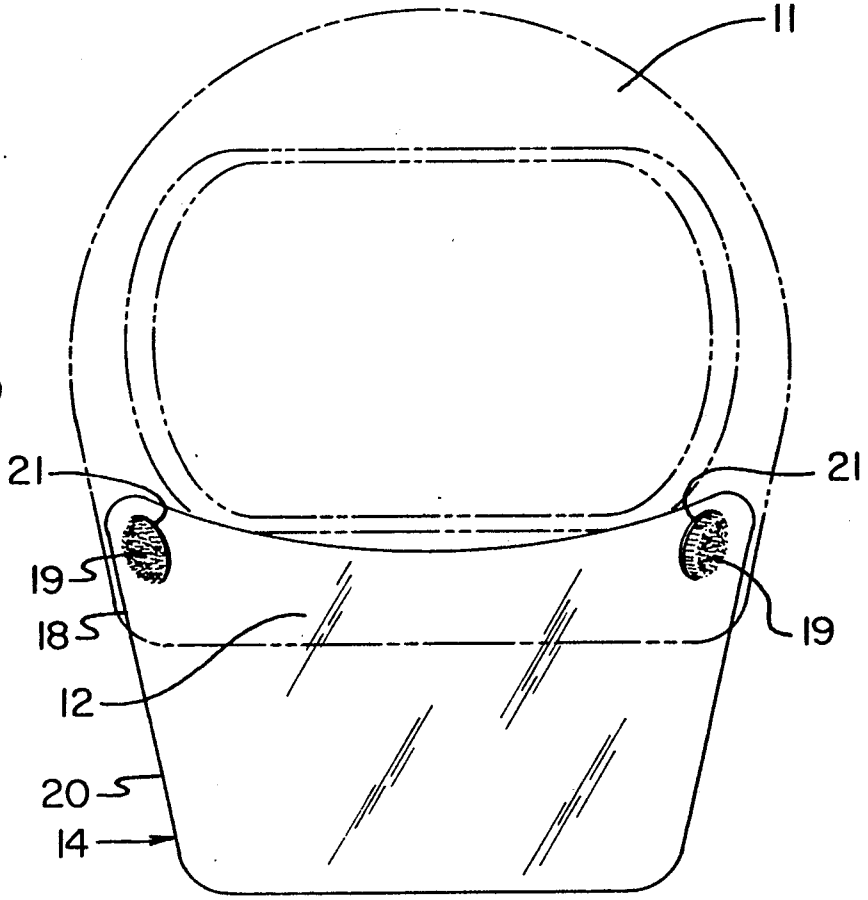
FIG. 2 is a front view of the helmet with neck-shielding apparatus shown in FIG. 1.
Figure 1:
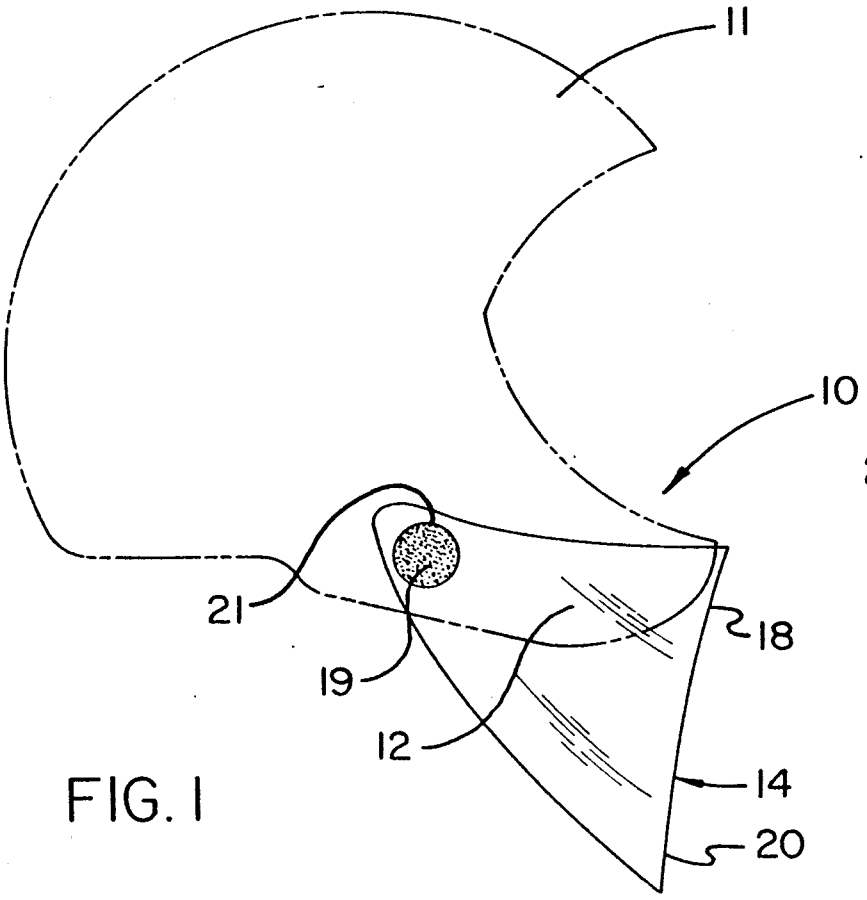
FIG. 1 is a side view showing a first preferred embodiment of the helmet with neck-shield of the invention.
Figure 3:
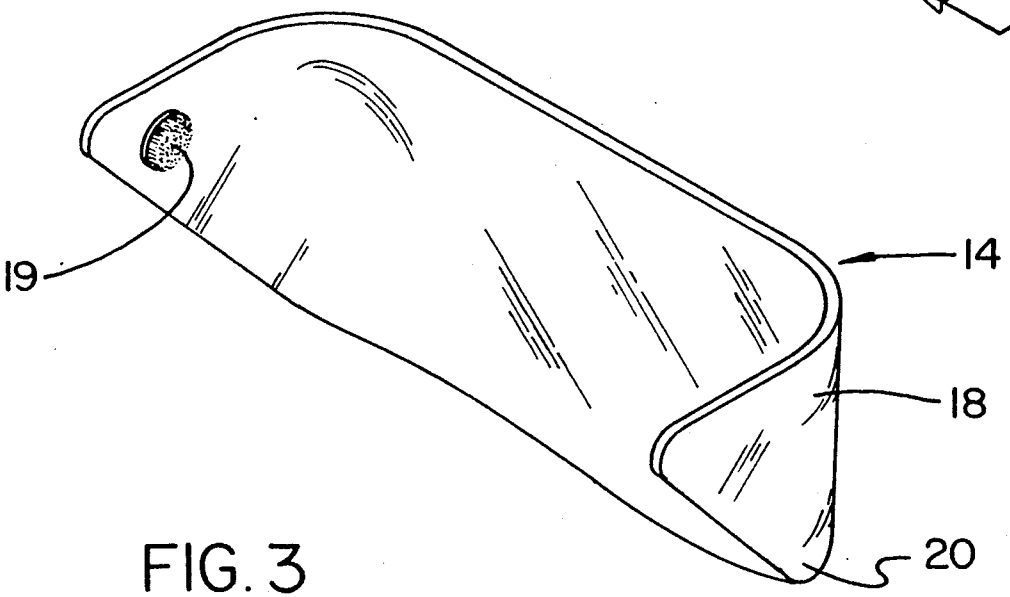
FIG. 3 is a rear perspective view of the neck-shielding assembly shown in FIGS. 1 and 2.

Turning initially to FIGS. 1–3, there is shown a first exemplary embodiment of the helmet with neck-shield of the invention generally designated by reference numeral 10. In its preferred form, helmet with neck-shield 10 is provided for a helmet 11 which has a chin and jaw protecting area 12. The apparatus includes a neck-shielding assembly 14 for protecting a neck area of a user without covering the eyes of the user. The neck-shielding assembly 14 includes a curved upper portion 18 capable of curving around the chin and jaw protecting area 12 of the helmet 11. A curved lower portion 20 extends downward from the curved upper portion 18 and is capable of curving around a portion of the neck area of the user.

A first connector 19 is attached to the curved upper portion 18. The first connector 19 connects the neck-shielding assembly 14 to the chin and jaw protecting area 12 of the helmet 11. The curved upper portion 18 supports the curved lower portion 20, and the curved lower portion 20 protects a portion of the neck area of the user from wind and airborne debris. A second connector 21 is attached to the chin and jaw protecting area 12 of the helmet 11. The second connector 21 connects to the first connector 19 and retains the neck-shielding assembly 14 on the helmet 11. In this way, the neck-shielding assembly 14 protects a portion of the neck of the user from wind and airborne debris without covering the eyes of the user. The first connector 19 and the second connector 21 includes complementary hook and loop connectors such as VELCRO (TM) connectors.

Figure 4:
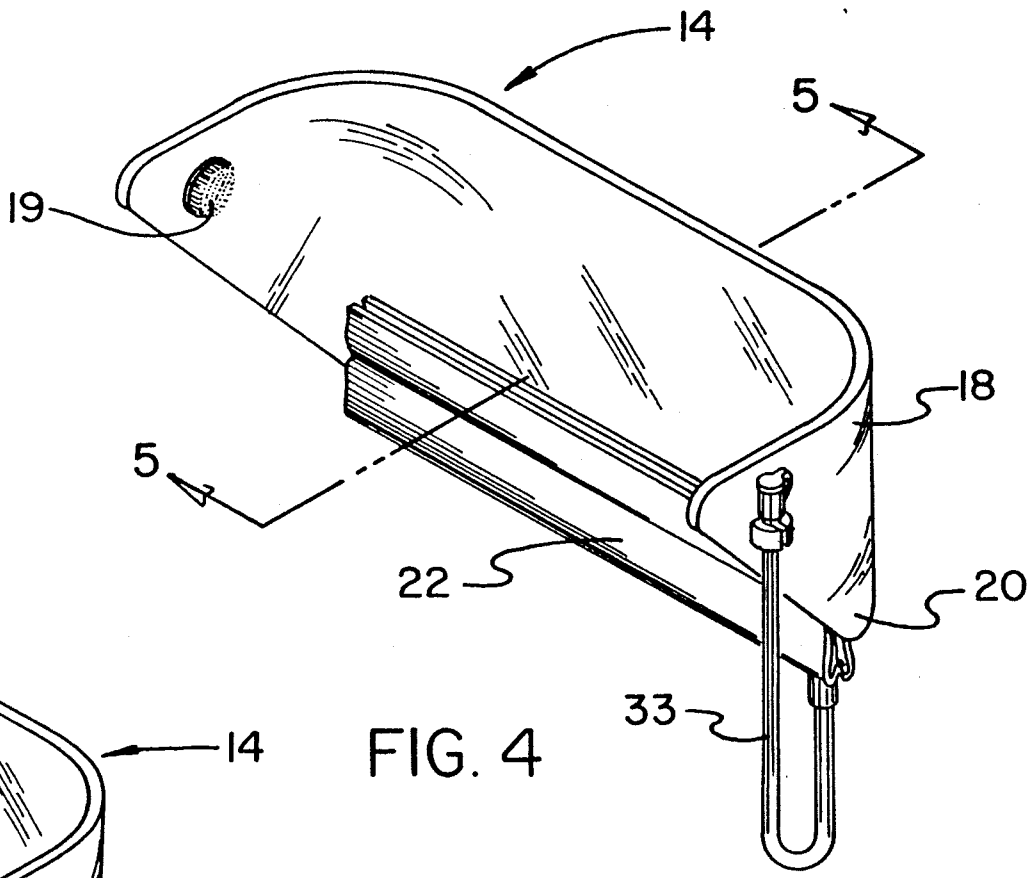
FIG. 4 is a rear perspective view of a second embodiment of the neck-shielding assembly of the invention which includes a first inflatable air bladder assembly means for restricting air flow between the curved lower portion of the neck-shielding assembly and the neck of the user.
Figure 5:
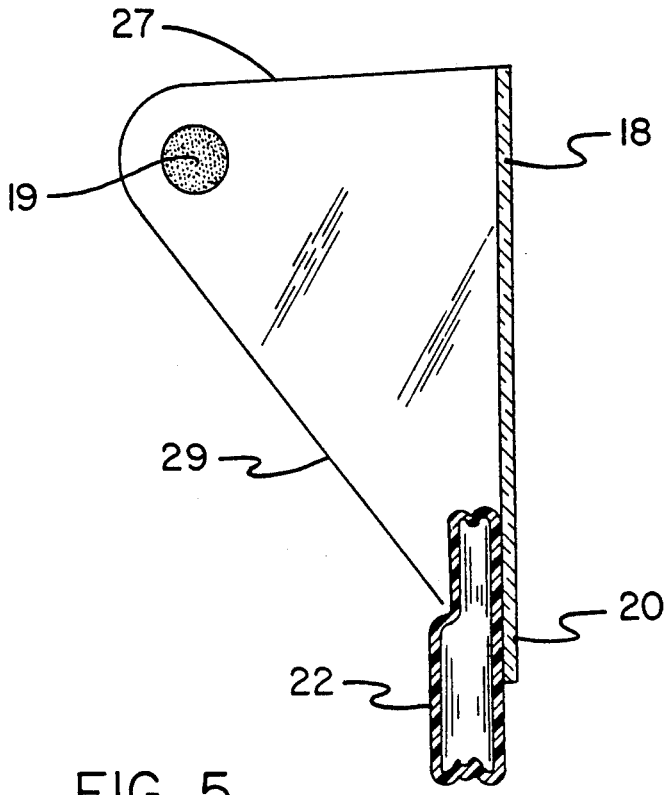
FIG. 5 is an enlarged cross-sectional view of the neck-shielding assembly shown in FIG. 4 taken along line 5—5 of FIG. 4.

Turning to FIGS. 4–5, a second embodiment of the invention is shown. Reference numerals are shown that correspond to like reference numerals that designate like elements shown in the other figures. In addition, a first inflatable air bladder assembly 22 is connected to the curved lower portion 20 for restricting air flow between the curved lower portion 20 of the neck-shielding assembly 14 and the neck of the user. The first inflatable air bladder assembly 22 is inflated through tube 33 which includes a cap for retaining air under pressure in the inflated bladder.

Figure 6:
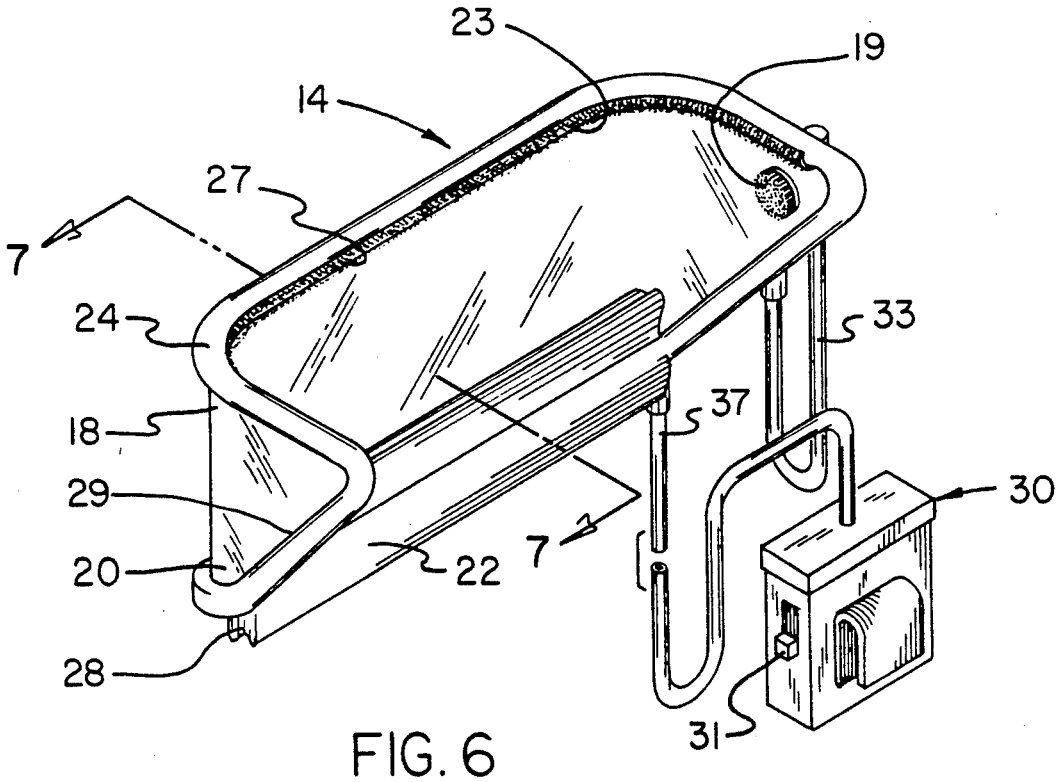
FIG. 6 is a rear perspective view of a third embodiment of the neck-shielding assembly of the invention which includes a second inflatable air bladder assembly connected to the curved upper portion of the neck-shielding assembly for restricting air flow between the curved upper portion and the chin and jaw protecting area of the helmet, and which also includes a heater assembly for warming the neck of the user.
Figure 7:
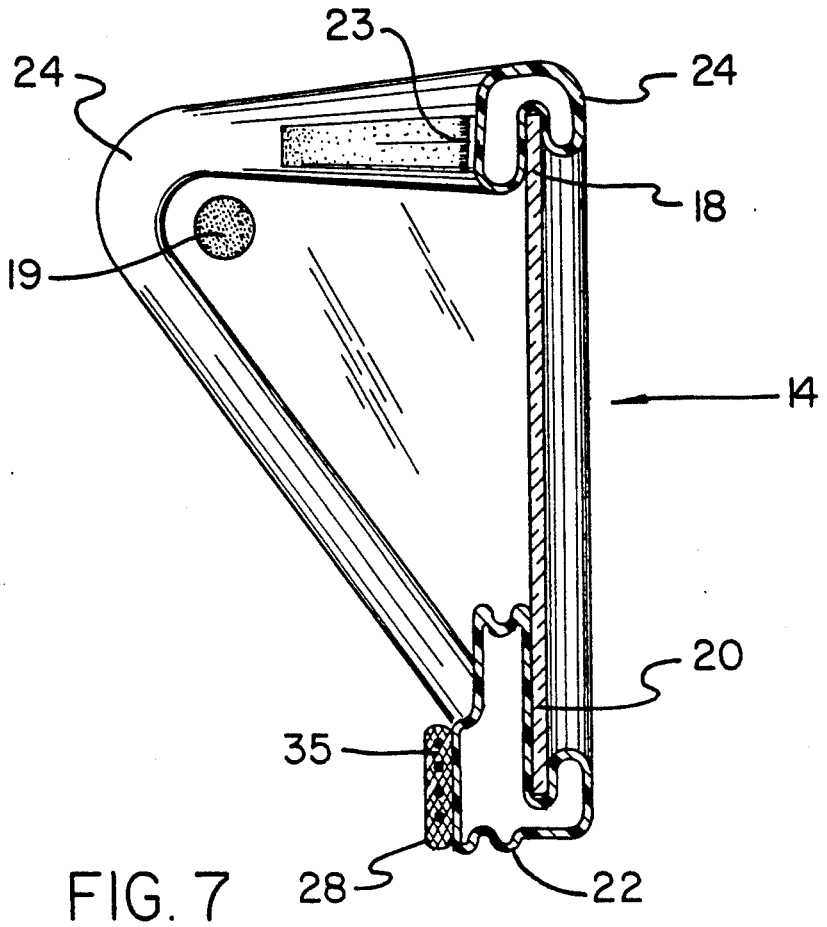
FIG. 7 is an enlarged cross-sectional view of the neck-shielding assembly shown in FIG. 6 taken along line 7—7 of FIG. 6.

As shown in FIGS. 6 and 7, a second inflatable air bladder assembly 24 is connected to the curved upper portion 18 for restricting air flow between the curved upper portion 18 and the chin and jaw protecting area 12 of the helmet 11. The second inflatable air bladder assembly 24 is connected to a first edge portion 27 of the curved upper portion 18 and to a second edge portion 29 of the curved lower portion 20 of the neck-shielding assembly 14. The first and second inflatable air bladder assemblies restrict air flow between the curved upper portion 18 and the curved lower portion 20 of the neck-shielding assembly 14 and the neck of the user. The first and second inflatable bladders are connected together, and the inflation tube 33 is used to inflate both the first and second air bladders.

A third connector 23 is connected to the second inflatable air bladder assembly 24 for attaching the neck-shielding assembly 14 to the helmet 11. A fourth connector (not shown) is connected to the helmet 11 in the chin and jaw protecting area 12. The fourth connector connects with the third connector 23 for attaching the neck-shielding assembly 14 to the helmet 11. The third connector 23 and the fourth connector includes complementary hook and loop connectors.

Figure 8:
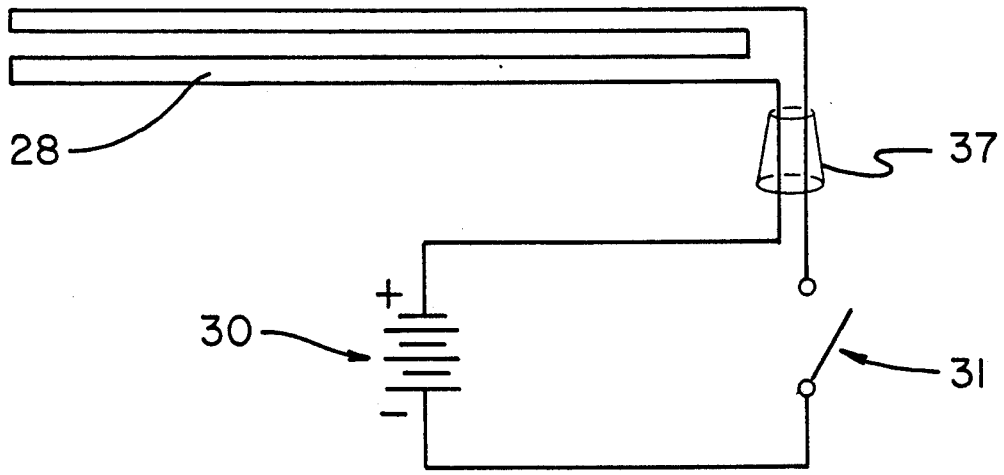
FIG. 8 is an electrical schematic diagram of the electric circuit used for powering the heater assembly shown in FIGS. 6 and 7.

Turning to FIGS. 6–8, a third embodiment of the invention is shown. Reference numerals are shown that correspond to like reference numerals that designate like elements shown in the other figures. In addition, a heater assembly is provided for warming the neck of the user. The heater assembly includes a heater element 28 and a battery power source 30 connected to the heater element 28 by cable 37. The heater element 28 is attached to the first inflatable air bladder assembly 22 which is attached to the curved lower portion 20 of the neck-shielding assembly 14 for warming the neck of the user. The heater element 28 is encased in insulation material 35. The battery power source 30 includes a rechargeable battery.

An on/off switch 31 is provided in the electrical circuit shown in FIG. 8 for controlling the flow of electric power from the battery power source 30 and the heater element 28.

The components of the helmet with neck-shielding apparatus of the invention can be made from inexpensive and durable plastic materials. Preferably, the neck-shielding assembly is made from clear plastic.

It is apparent from the above that the present invention accomplishes all of the objects set forth by providing a new and improved helmet with neck-shield that is low in cost, relatively simple in design and operation, and which may advantageously be used to prevent wind from entering a rider's chest area under a jacket and a rider's head area under a helmet by way of the rider's neck. With the invention, a helmet with neck-shielding apparatus is provided which protects a rider's neck from wind injury. With the invention, a neck-shielding apparatus is provided which protects a rider's neck from flying rocks and stones and contact with flying insects at high speed. With the invention, a helmet with neck-shielding apparatus is provided which protects the neck of the rider and is comfortable to wear. With the invention, a neck-shielding apparatus is provided which protects a rider's neck and is easily used and manipulated. With the invention, a helmet with neck-shielding apparatus is provided which protects the neck of the rider without constricting the rider's neck and head movement.

With the invention, a neck-shielding apparatus is provided which employs an air cushion for protecting a rider's neck area. With the invention, a neck-shielding apparatus is provided which employs the principles of an inflatable seal to protect a rider's neck area from the wind. With the invention, a helmet with neck-shield is provided which includes an active source of heat for warming the rider's neck area. With the invention, a helmet with neck-shielding apparatus is provided which provides neck protection without adding a visual obstacle to the wearer. With the invention, a helmet with neck-shield is provided which is readily attached to and detached from the helmet. With the invention, a helmet with neck-shield is provided which is not attached at the top of the helmet.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A helmet with neck-shielding apparatus for a helmet which has a chin and jaw protecting area, comprising:

neck-shielding assembly means for protecting a neck area of a user without covering eyes of the user, said neck-shielding assembly means including a curved upper portion capable of curving around the chin and jaw protecting area of the helmet, a curved lower portion extending downward from said curved upper portion and capable of curving around a portion of the neck area of the user, and first connector means attached to said curved upper portion, said first connector means for connecting said neck-shielding assembly means to the chin and jaw protecting area of the helmet, said curved upper portion for supporting said curved lower portion, and said curved lower portion for protecting a portion of the neck area of the user, second connector means, attached to the chin and jaw protecting area of the helmet, for connecting to said first connector means for retaining said neck-shielding assembly means on the helmet, such that said neck-shielding assembly means protect a portion of the neck of the user without covering the eyes of the user, and first inflatable air bladder assembly means, connected to said curved lower portion and positioned between said curved lower portion and the neck of the user, for restricting air flow between said curved lower portion of said neck-shielding assembly means and the neck of the user.

2. The apparatus described in claim 1 wherein said first connector means and said second connector means include complementary hook and loop connectors.

3. The apparatus described in claim 1, further including:

second inflatable air bladder assembly means, connected to said curved upper portion, for restricting air flow between said curved upper portion and the chin and jaw protecting area of the helmet.

4. The apparatus described in claim 3 wherein said second inflatable air bladder assembly means are connected to a first edge portion of said curved upper portion and to a second edge portion of said curved lower portion of said neck-shielding assembly means for restricting air flow between said curved upper portion and said curved lower portion of said neck-shielding assembly means and the neck of the user.

5. The apparatus described in claim 4, further including:

third connector means, connected to said second inflatable air bladder assembly means, for attaching said neck-shielding assembly means to the helmet, and fourth connector means, connected to the helmet in the chin and jaw protecting area, for connecting with said third connector means, for attaching said neck-shielding assembly means to the helmet.

6. The apparatus described in claim 5 wherein said third connector means and said fourth connector means include complementary hook and loop connectors.

7. The apparatus described in claim 1, further including:

heater assembly means for warming the neck of the user, said heater assembly means including a heater element and a battery power source connected to said heater element, said heater element attached to said first inflatable air bladder assembly means for warming the neck of the user.

8. The apparatus described in claim 7 wherein said battery power source includes a rechargeable battery.

9. The apparatus described in claim 1, further including:

second inflatable air bladder assembly means, connected to said curved upper portion, for restricting air flow between said curved upper portion and the chin and jaw protecting area of the helmet, and heater assembly means for warming the neck of the user, said heater assembly means including a heater element and a battery power source connected to said heater element, said heater element attached to said curved lower portion for warming the neck of the user.

* * * * *